United States Patent [19]

Franzen

[11] 4,062,067

[45] Dec. 13, 1977

[54] PROTECTIVE HEADGEAR

[76] Inventor: Harry A. Franzen, 2907 W. 33rd, Apt. D, Anchorage, Alaska 99503

[21] Appl. No.: 711,277

[22] Filed: Aug. 3, 1976

[51] Int. Cl.[2] ..... A42B 1/06

[52] U.S. Cl. ..... 2/410

[58] Field of Search ..... 2/410, 411, 412, 413, 2/414, 420, 421, 423, DIG. 11, 171, 174, 195, 181

[56] References Cited

U.S. PATENT DOCUMENTS

| | | | |
|---|---|---|---|
| 1,072,321 | 9/1913 | Fitch | 2/413 |
| 2,594,478 | 4/1952 | Moore | 2/413 |
| 2,969,547 | 1/1961 | Dye | 2/411 |

FOREIGN PATENT DOCUMENTS

| | | | |
|---|---|---|---|
| 380,559 | 9/1923 | Germany | 2/9 |
| 350,142 | 6/1931 | United Kingdom | 2/420 |

*Primary Examiner*—Alfred R. Guest

*Attorney, Agent, or Firm*—Farkas, Robert D.

[57] ABSTRACT

A protective headgear having two transverse cushioned bands adjustable in length by the use of multiple hook and loop fasteners.

3 Claims, 4 Drawing Figures

PROTECTIVE HEADGEAR

BACKGROUND OF THE INVENTION

1. Field of the Invention

This invention relates to protective headgear and, in particular, to headgear readily adjustable in size.

2. Prior Art

Protective headgear has been worn for thousands of years. In relatively recent times, as we have begun to understand both the nature of damage to the head and the forces that may cause the damage, cushioned headgear has been developed.

FROTHINGHAM discloses in U.S. Pat. No. 2,717,384 a dress and protective hat which does not seem to have adequate adjustability.

SUMMARY OF THE INVENTION

It is therefore an object of this invention to overcome the limitations and disadvantages in the protective headgear in the prior art and currently available in the market.

One of the objects of the invention is to provide a protective headgear embodying improved principles of design and construction.

An important object of the invention is to provide a protective headgear which is comprised of a minimum number of simple durable parts or components which can be economically manufactured and readily assembled.

A significant object of the invention is to provide a protective headgear so designed and constructed that it can be easily applied to almost any typical head.

Another object of the invention is to provide an attractive headgear capable of mounting intriguing accessories like feathers.

A further object of the invention is to provide a cushioned anti-impact protective headgear.

Yet another object of the invention is to provide adjustable size protective headgear.

A still further object of the invention is to provide additional chin protection.

A protective headgear comprises, according to the principles of this invention, a pair of cushioned bands transversely assembled, multiple hook and loop fasteners employed to close the bands, additional chin protector, snap fasteners, and holes for retaining feathers.

Further objects and advantages of this invention will appear more clearly from the following description of a non-limiting illustrative embodiment and the accompanying drawings in which like numerals designate like parts throughout the several views.

BRIEF DESCRIPTION OF THE DRAWING

Briefly summarized, a preferred embodiment of the invention is described in conjunction with an illustrative disclosure thereof in the accompanying drawings, in which.

DETAILED DESCRIPTION OF THE PREFERRED EMBODIMENT

Figure 1:
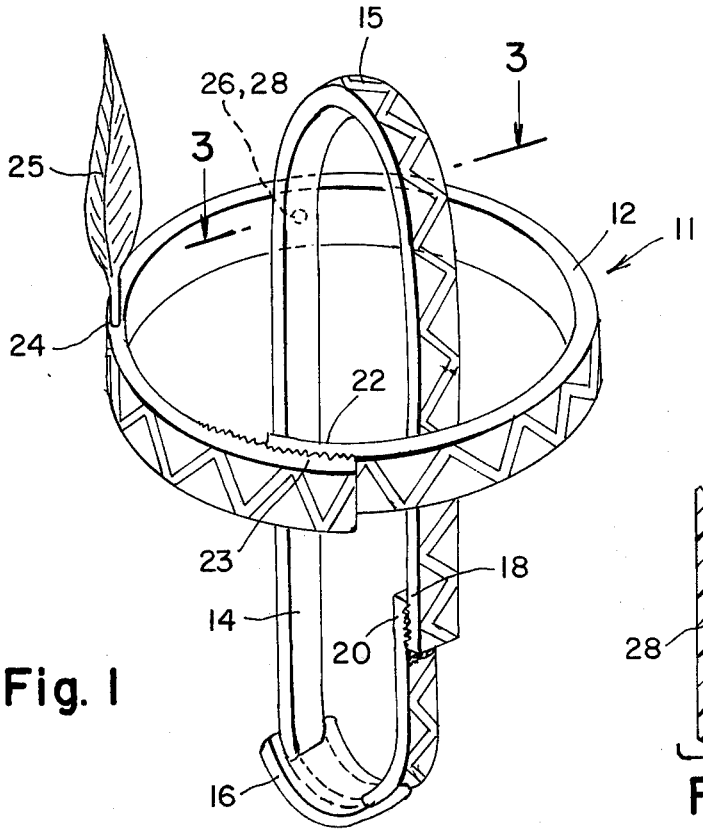
FIG. 1 is a pictorial representation of the protective headgear according to the principles of this invention.
Figure 3:
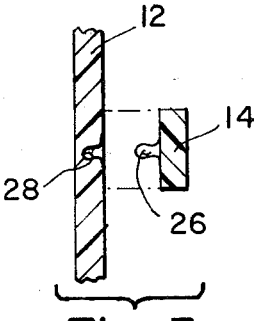
FIG. 3 is a partial cross-section view taken substantially along plane 3—3 in FIG. 1.
Figure 2:
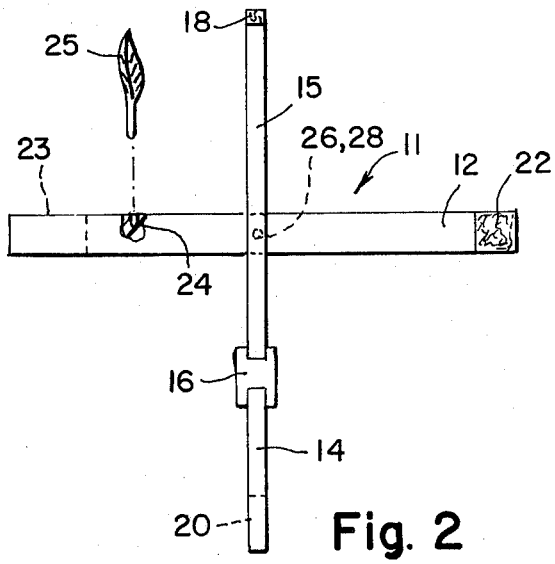
FIG. 2 is a side elevation of the invention showing the bands opened and stretched out.
Figure 4:
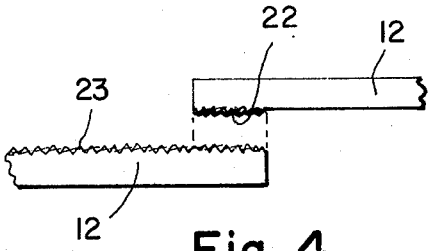
FIG. 4 is a detail view showing the multiple hook and loop fasteners used to connect the ends of a band.

In the drawings a protective headgear 11 embodying features of the invention is illustrated comprising a substantially horizontal headband 12 interconnected to a substantially vertical chin 14 and crown 15 band, each band having ends 18, 20, 22, 23 provided with multiple loop 20, 23 fasteners for engagement with multiple hook 18, 22 fasteners to effect closure and to permit adjustment in band length by virtue of the length of at least one fastener group in each set.

Each band is made of, or lined with, impact protecting cushioning material.

Additional protection may be provided at specific points on either band by providing movable cushioned protectors such as the chin protector 16.

The vertical band may be removably interconnected to the horizontal band by the use of snap fasteners 26, 28 or other known removable type fasteners particularly those used for garments.

Permanent connection of the bands may be effected by known attaching methods including sewing, riveting and the like.

It is particularly desirable for children to wear protective headgear and to encourage mothers to purchase and children to wear such headgear, a particularly attractive and intriguing appearance is important. Such appearance may be achieved by decoration of the exterior of the bands, by using brightly colored materials, and by providing accessories such as feathers 25 whose quills may be inserted into holes 24 in a band in such direction as not to cause the quill to be driven to the child's head upon impact. Other soft accessories may be attached for further enhancement of appearance as viewed by a child.

Flame resisting material should be employed and preferably fungus resistant material.

From the foregoing, the construction and operation of the device will be readily understood and further explanation is believed superfluous.

The invention includes all novelty residing in the description and drawings. It is obvious to those skilled in the art that various minor changes can be made without departing from the concept of this invention and all such as fall within the reasonable scope of the appended claims are included.

I claim:

1. A protective headgear comprising a pair of bands, one of said pair of bands having two free ends, the other of said pair of bands, having two free ends, fastening means for fastening together each of said two free ends of said one band to each other, said fastening means for fastening said two free ends of said other band to each other, said fastening means for fastening said free ends in overlying relationship to one another at an infinite variety of locations along a portion of the length of each of said pair of bands adjacent one of the free ends of each band, said fastening means including a plurality of multiple loop fasteners being disposed on one lateral surface adjacent one free end of each band and a plurality of multiple hook fasteners being disposed on the other lateral surface of each band adjacent the other free end thereof, said one band having at least a pair of openings disposed in said one lateral surface thereof, said other band having at least a pair of snap fasteners fixedly secured to said other lateral surface, said pair of snap fasteners for removable snapping engagement within said pair of openings, at least one hole disposed in a marginal edge extending intermediate said lateral surfaces of said one band, said first and said second bands fabricated from an impact absorbing material, said free ends of said other band being disposed in a location intermediate said at least said pair of snap fasteners and closest one of said pair of snap fasteners.

2. A protective headgear as claimed in claim 1 further comprising a feather, said feather having a quill, said quill being disposed inserted in said hole.

3. A protective headgear as claimed in claim 1 further comprising a sheet of impact absorbing material, said sheet of impact absorbing material secured to said other band at a location adjacent one of said free ends thereof.

* * * * *